US005375736A

United States Patent [19]

Gonzalez et al.

[11] Patent Number: 5,375,736

[45] Date of Patent: Dec. 27, 1994

[54] PAINTBRUSH HOLDER

[76] Inventors: Donald G. Gonzalez, 1668 N. Acacia Ave., Rialto, Calif. 92376; Gottfried E. Haug, 8 Blacksmith Cir., Phillips Ranch, Calif. 91766

[21] Appl. No.: 69,419

[22] Filed: Jun. 1, 1993

[51] Int. Cl.[5] ..... B65D 25/20

[52] U.S. Cl. ..... 220/697; 220/700

[58] Field of Search ..... 220/695, 697, 699, 700, 220/701

[56] References Cited

U.S. PATENT DOCUMENTS

| | | | |
|---|---|---|---|
| 2,469,864 | 5/1949 | Craft et al. | 220/697 X |
| 2,535,260 | 12/1950 | Braswell | 220/697 |
| 2,567,326 | 9/1951 | Entsminger | 220/697 |
| 2,625,299 | 1/1953 | Uhlig | 220/697 X |
| 2,699,882 | 1/1955 | Lieb | 220/697 X |
| 3,275,187 | 9/1966 | Lamoureaux | 220/700 |
| 3,948,413 | 4/1976 | Gorrell et al. | 220/697 X |
| 4,014,453 | 3/1977 | Tarnacki | 220/697 |
| 4,266,686 | 5/1981 | Carter | 220/697 |
| 4,275,818 | 6/1981 | Church | 220/697 |

FOREIGN PATENT DOCUMENTS

| | | | |
|---|---|---|---|
| 485197 | 7/1952 | Canada | 220/697 |
| 2225309 | 5/1990 | United Kingdom | 220/697 |

*Primary Examiner*—Allan N. Shoap
*Assistant Examiner*—Stephen Cronin
*Attorney, Agent, or Firm*—Roy A. Ekstrand

[57] ABSTRACT

A paintbrush holder includes a horizontal portion supporting a resilient edge attachment securable to a variety of paint can configurations. An upwardly angled portion extends from the horizontal portion and terminates in a concave upwardly facing notch having extending prongs on either side thereof. A triangularly shaped extended portion extends downwardly from the horizontal portion and terminates in a straight edge useful for paint masking. The brush holder further includes an upwardly extending tab used in retaining or securing a paintbrush rested upon the paintbrush holder such that the paintbrush handle is received within the upwardly facing concave notch while the paintbrush bristle portion rests upon and extends downwardly from the triangular extension.

7 Claims, 2 Drawing Sheets

PAINTBRUSH HOLDER

FIELD OF THE INVENTION

This invention relates generally to painting apparatus and particularly to devices employed to temporarily hold a paint bearing paintbrush.

BACKGROUND OF THE INVENTION

Hand painting operations utilizing a quantity of paint and a paintbrush comprise one of the most common decorating and renovating techniques used to enhance the appearance of objects such as dwellings, houses, commercial buildings or other structures and a virtually endless array of apparatus such as furniture or the like. The typical paintbrush used in such hand painting operations is subject to substantial size and shape variation. However, generally all such brushes include an elongated handle for supporting a plurality of flexible thin bristles or hairs in a bunched array.

Generally, such brushes are used with a paint container which may vary in size from relatively small metal or plastic cans having capacities of one gallon or less as well as large commercial grade five gallon cans used in high volume painting operations. In a typical painting process, the brush is repeatedly immersed to a selected depth within the supply of paint and thereafter used to brush on or deposit the paint upon the to-be-painted surface. Some skill is usually required to properly manipulate the brush to obtain the appropriate supply of paint upon the bristles each time the brush is reimmersed within the paint. Care is also taken to avoid dripping excessive paint upon the surrounding area of the paint container as well as the surface itself. This painting process continues generally until the task is completed or the paint supply is depleted. In most instances, however, the painting process is interrupted periodically to perform supporting tasks such as moving equipment or ladders, covering surrounding objects or areas, or to perform tasks such as edge masking or the like. During these interruptions, the painter needs to rest the paintbrush at some convenient location. This need to periodically rest the paintbrush upon a convenient surface or container can however become a problem due to the quantity of paint which remains upon portions of the paintbrush bristle or hairs raising the possibility of contamination of the brush from some dirt laden surfaces or undesired mess due to paint deposit upon surfaces not intended to be painted. Thus, a genuine problem arises in providing such a convenient resting place.

To meet this need, practitioners in the art have provided various devices configured to provide a convenient resting surface for a paint laden paintbrush during these interruptions in the painting process. Perhaps, one of the most effective devices provided comprises a cast metal member having an elongated center shaft terminating at one end in an upwardly angled riser having a U-shaped portion for resting a paintbrush handle. The remaining end of the paintbrush holder supports a crossbar extending transversely used to rest the bristles or hair of the paintbrush as the handle rests in the U-shaped portion. The crossbar defines an upwardly extending tab or prong which engages the bristle or hair array of the brush to maintain its position. A screw clamp and bracket extends downwardly from the elongated portion of the brush holder and is used to engage the upper edge portion of the paint container in a secure attachment. This device proved relatively effective and desirable in that it supports the paint laden bristles of the brush in a manner extending into the paint container above the paint surface. Unfortunately, the device also proved relatively difficult to secure to and remove from the paint can upper edges and was only unfortunately relatively expensive to produce.

In further attempts on the part of practitioners to meet this need, other devices have been provided. For example, generally planar grille structures having means for attachment to the upper portion of the paint can have been provided as well as certain devices used to suspend or retain the brush above the paint surface within the interior of the paint can.

Despite this effort on the part of practitioners in the art, there remains nonetheless a continuing need in the art for an inexpensive, easy to fabricate and effective paintbrush holder which overcomes the problems and limitations of the prior art devices.

SUMMARY OF THE INVENTION

Accordingly, it is a general object of the present invention to provide an improved paintbrush holder. It is a more particular object of the present invention to provide an improved paintbrush holder which is easily attached to and removed from a paint container and which may be fabricated in a relatively inexpensive manner. It is a further object of the present invention to provide such an improved paintbrush holder which is also capable of additional supporting activities in connection with the hand painting process.

In accordance with the present invention, there is provided for use in combination with a paint container defining an upper edge, a paintbrush holder comprises: a frame defining a horizontal portion, a generally triangular extended portion extending downwardly from the horizontal portion, and an upwardly angled portion extending from the horizontal portion generally opposite from the generally triangular extended portion and defining a notch therein; edge attachment means extending downwardly from the horizontal portion for snap-fit attachment to the upper edge of the paint container; and a tab extending upwardly from the generally triangular extended portion for engaging a paintbrush resting upon the holder.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
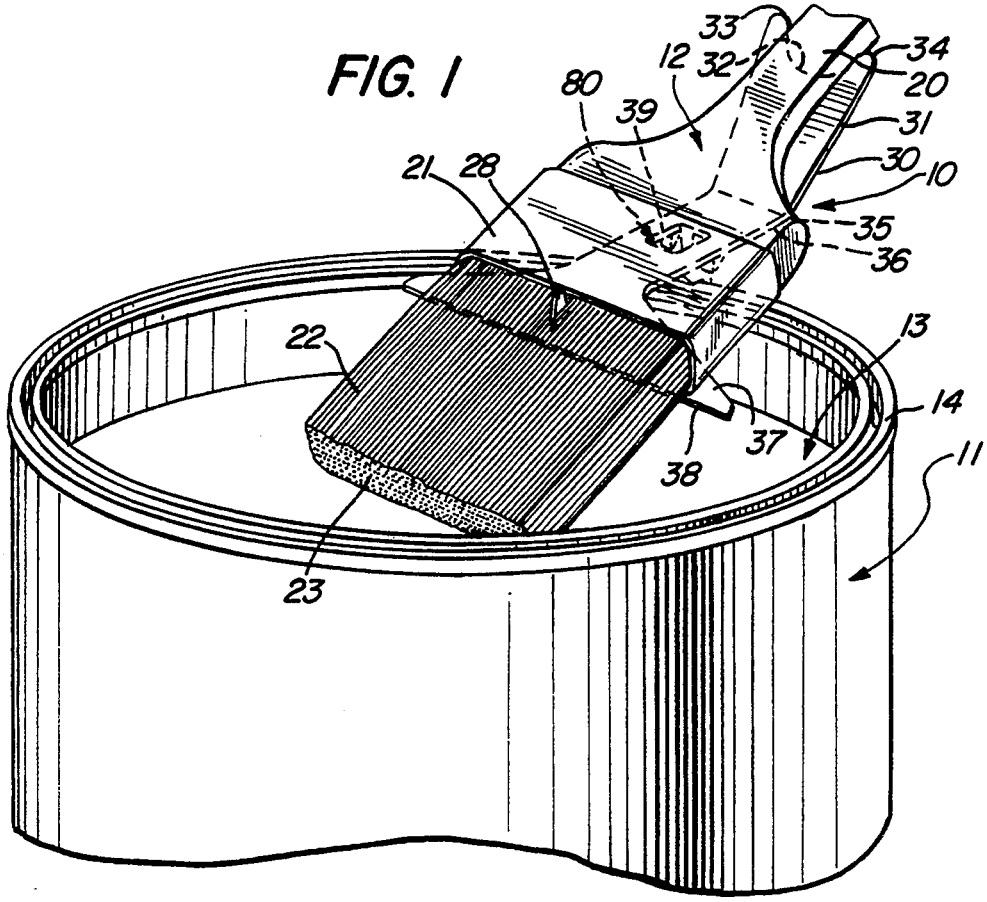
FIG. 1 sets forth a perspective view of a paintbrush holder constructed in accordance with the present invention secured to a typical paint container and supporting a typical paintbrush.

FIG. 1 sets forth a perspective view of a brush holder constructed in accordance with the present invention and generally referenced by numeral 10. Brush holder 10 is shown in combination with a conventional paint can 11 having an upper edge 14 and supporting a quantity of paint 13 within the can interior. Also shown in FIG. 1 is a conventional paintbrush generally referenced by numeral 12 having a handle 20, a bristle support 21 and a plurality of bristles 22 secured thereto. Bristles 22 terminate in a plurality of bristle ends 23. Brush holder 10 is preferably formed as a single integral molded plastic frame generally referenced by numeral 30. Frame 30 includes a horizontal portion 36 coupled to an upwardly angled portion 31. Angled portion 31 terminates in a pair of extending prongs 33 and 34 having a concave notch 32 formed therebetween. Frame 30 further includes a triangular shaped extended portion 37 defining a straight edge portion 38. A tab 28 extends upwardly from extended portion 37 and is generally centered with respect to edge 38 and extended portion 37. Horizontal portion 36 further defines an aperture 39 together with an edge attachment generally referenced by numeral 40. The structure of edge attachment 80 is set forth below in greater detail in FIGS. 4, 5 and 6. However, suffice it to note here that edge attachment 80 includes a plurality of downwardly extending posts and tabs configured to engage edge 14 of paint can 11 such that horizontal portion 36 is maintained in a generally horizontal orientation in the manner shown.

Thus, edge attachment 80 securely couples brush holder 10 to upper edge 14 of paint can 11. This secure attachment is, by means described below in greater detail, preferably configured to provide a "snap-fit" or forced type attachment which utilizes the resilience of the material from which brush holder 10 is preferably molded to provide a pressed on removable attachment which securely maintains brush holder 10.

In its anticipated use, brush holder 10 receives and supports a conventional paintbrush such as paintbrush 12 in the manner shown in FIG. 1 in which handle 20 is received within and rests upon notch 32 of angled portion 31. Concurrently, bristles 22 rest upon extended portion 37 and extend beyond edge 38 into the interior of paint can 11 in an angular disposition shown in FIG. 4 below. Tab 28 extends between bristles 22 and provides an engagement between paint brush 12 and brush holder 10 which precludes sliding motion of paintbrush 12 downwardly beyond the position shown in FIG. 1.

Thus, brush holder 10 provides a convenient, temporary resting place for a paint laden paintbrush which receives the paintbrush in a convenient manner and which securely maintains the paintbrush. The attachment of brush holder 10 is carried forward in a simple force fit type attachment and thus the need for fasteners or clamps or the like is avoided making brush holder 10 easily removable from paint can 11. Prongs 33 and 34 are sufficiently thin at their end portions to facilitate the use of angled portion 31 and, in particular, prongs 33 and 34 in the operation of removing paint can lids by providing a convenient pair of prying blades further adding to the flexibility and use of the present invention brush holder. In addition, edge 38 is preferably formed as a straight edge which is utilized in providing a convenient masking tool for painting operations. Thus, extended portion 37 together with edge 38 may be used as a "painting shield" in which, for example, the user is able to force edge 38 against the inside corner junction between a to-be-painted surface and a surface which is not to be painted. When so positioned, edge 38 provides a clear edge line or masking line as the paintbrush is passed across the to-be-painted surface and as extended portion 37 provides a protective shield for the surface not to be painted. Because brush holder 20 is formed of a molded plastic material or the like, the cleaning of brush holder 10 is made easy in that the entire unit may be washed without the need to disassemble any arrangement of components. It should also be noted that brush holder 10 is capable of receiving a virtually endless variety of brush shapes and sizes and is not subject to limitations due to the length of paintbrush handle or length and/or arrangement of paint bristles.

Figure 2:
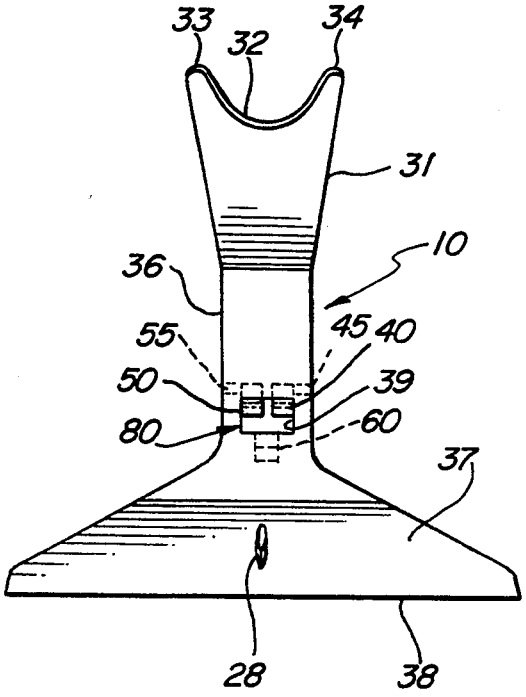
FIG. 2 sets forth a top view of the present invention paintbrush holder.

FIG. 2 sets forth a top view of brush holder 10. Brush holder 10 as described above includes a frame 30 preferably formed of a molded plastic material or the like and defining a horizontal portion 36 defining an aperture 39 therein and coupled to an upwardly extending angled portion 31. Angled portion 31 terminates in an upwardly facing concave notch 32 having extending prongs 33 and 34 on either side thereof. Frame 30 further defines a generally triangular extended portion 37 terminating in a straight edge 38. A tab 28 extends upwardly from triangular extended portion 37. Brush holder 10 further includes an edge attachment 80 comprising a pair of downwardly extending posts 40 and 50 together with a downwardly extending post 60, the structure of which is better below in FIG. 6. Edge attachment 80 further includes a pair of triangular shaped tabs 45 and 55.

Figure 3:
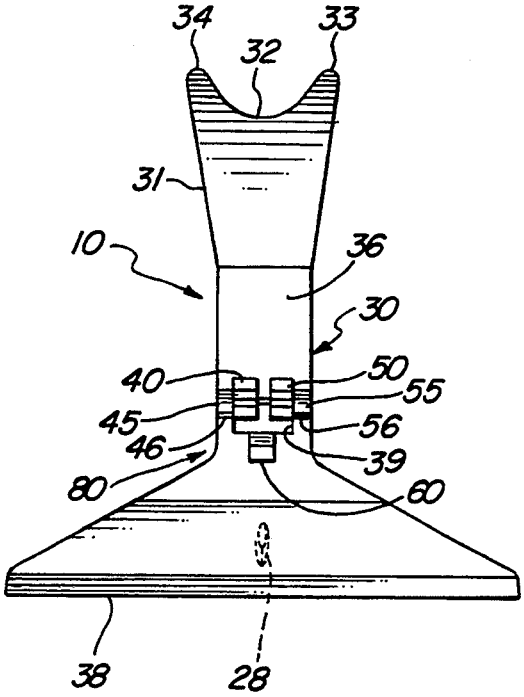
FIG. 3 sets forth a bottom view of the present invention paintbrush holder.

FIG. 3 sets forth a bottom side view of brush holder 10. As described above, brush holder 10 includes a frame 30 preferably formed of a molded plastic material which includes a horizontal portion 36, an upwardly extending angled portion 31 and a triangular extended portion 37. Angled portion 31 defines a concave notch 32 having a pair of prongs 33 and 34 on either side thereof. Extended portion 37 defines a straight edge 38 having an upwardly extending tab 28 (better seen in FIG. 2). Horizontal portion 36 defines an aperture 39 having a pair of triangularly shaped tabs 45 and 55 on either side thereof which in turn define respective planar surfaces 46 and 56. A pair of downwardly extending posts 40 and 50 are spaced equally with respect to aperture 39. A center post 60 is positioned on one edge of aperture 39 and is generally centered with respect to posts 40 and 50.

Figure 4:
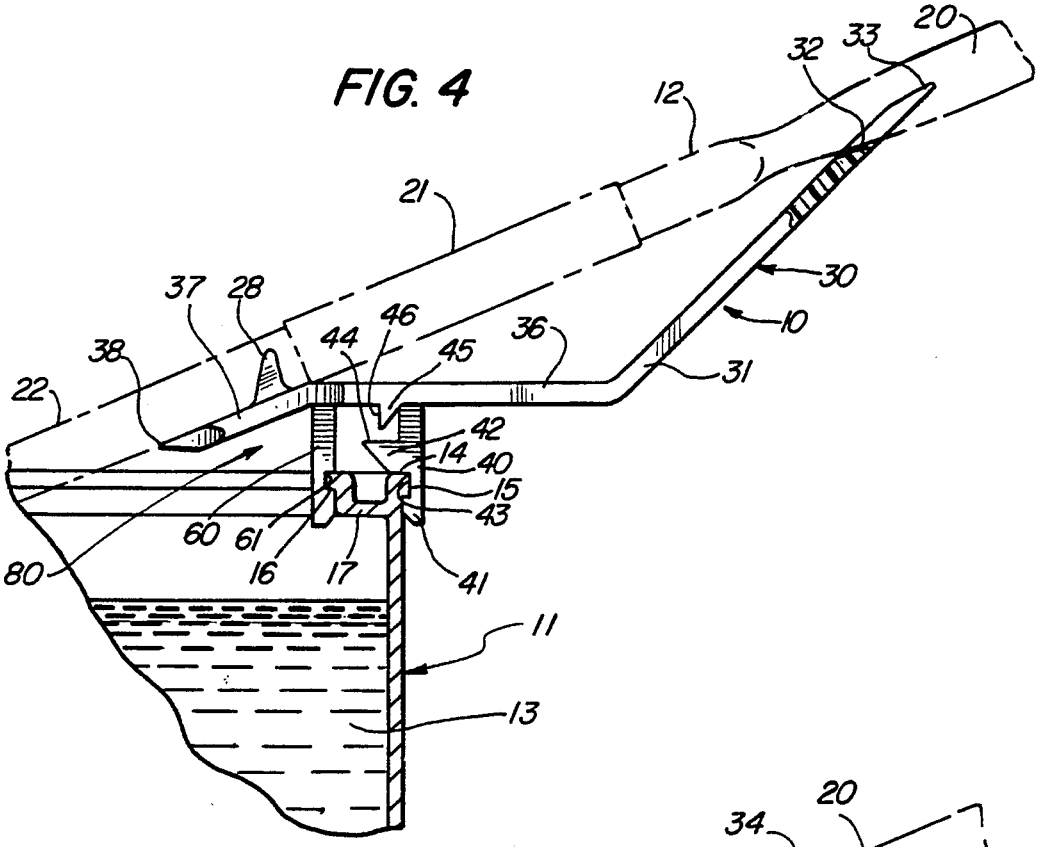
FIG. 4 sets forth a partially sectioned side view of the present invention paintbrush holder secured to a typical one gallon paint container.

FIG. 4 sets forth a partial section view of the present invention brush holder secured to a conventional paint can generally referenced by numeral 11. Paint can 11 is constructed in accordance with conventional fabrication techniques and thus receives a quantity of paint 13 within its interior. Paint can 11 further includes an upper edge 14 having a generally U-shaped portion 17 extending inwardly from edge 14. U-shaped portion 17 defines an outwardly extending lip 15 and an inwardly extending lip 16. Within the paint industry, the structure of upper edge 14, U-shaped portion 17 and lip portions 15 and 16 is generally standardized and thus the majority, if not all, of the presently used paint cans having capacities of one gallon or less could be anticipated to utilize the edge structure shown in FIG. 4.

Brush holder 10 is preferably fabricated of a molded plastic material having a frame 30 defining a horizontal portion 36, a triangular extended portion 37 and an upwardly angled portion 31. Angled portion 31 terminates in an upwardly facing concave notch 32 having a pair of prongs 33 and 34 (seen in FIG. 1) extending on either side of notch 32. Triangular extended portion 37 defines an upwardly extending tab 28 and a straight edge 38. Brush holder 10 further includes an edge attachment generally referenced by numeral 40. The structure of edge attachment 80 is better seen in FIG. 6. However, suffice it to note here that edge attachment 80 includes a downwardly extending post 60 defining a notch 61 therein. Edge attachment 80 further includes a downwardly extending triangular tab 45 having a planar surface 46 and a downwardly extending post 40. Post 40 defines an inwardly extending tab 41 and a triangular tab 42 spaced therefrom to form a notch 43 therebetween. Tab 42 further defines a planar surface 44. As is better seen in FIG. 6, edge attachment 80 further includes an additional tab 55 identical to tab 45 and defining an identical planar surface 56. Edge attachment 80 also includes a downwardly extending post 50 generally identical to post 40 and defining a pair of inwardly extending tabs 51 and 52 defining a notch 53 therebetween. Tab 52 defines a planar surface 54.

Thus, in the attachment of brush holder 10 to edge 14 of paint can 11, tabs 40, 50 and 60 are forced downwardly upon lip portions 15 and 16 of upper edge 14. The angled surfaces formed at the lower portions of posts 40, 50 and 60 cause posts 40, 50 and 60 to bend outwardly as brush holder 10 is forced downwardly upon upper edge 14 of paint can 11. With continued downward pressure upon brush holder 10, posts 40, 50 and 60 are snapped upon lips 15 and 16 of upper edge 14 until lip 15 is received within notches 43 and 53 of posts 40 and 50 and lip 16 is received within notch 61 of post 60. At that point, the resilience of posts 40, 50 and 60 completes the snap-fit adjustment by flexing inwardly to grasp lips 15 and 16 in the manner shown in FIG. 4. Once brush holder 10 has been secured to upper edge 14 of paint can 11 in the manner shown, a conventional brush 17 having a handle 20, a bristle support 21 and a plurality of bristles 22 is received upon brush holder 10 in the manner shown such that handle portion 20 is received within notch 32 while the upper portion of bristles 22 rests upon triangular extended portion 37 of brush holder 10. As is also described above, tab 28 is received between bristles 22 and extends upwardly to engage bristles 22 and maintain brush 12 upon brush holder 10. The removal of brush holder 10 from edge 14 of paint can 11 is achieved by prying posts 40, 50 and 60 outwardly, preferably with a tilting action to withdraw notches 43, 53 and 61 from lips 15 and 16 and thereby release brush holder 10.

Figure 5:
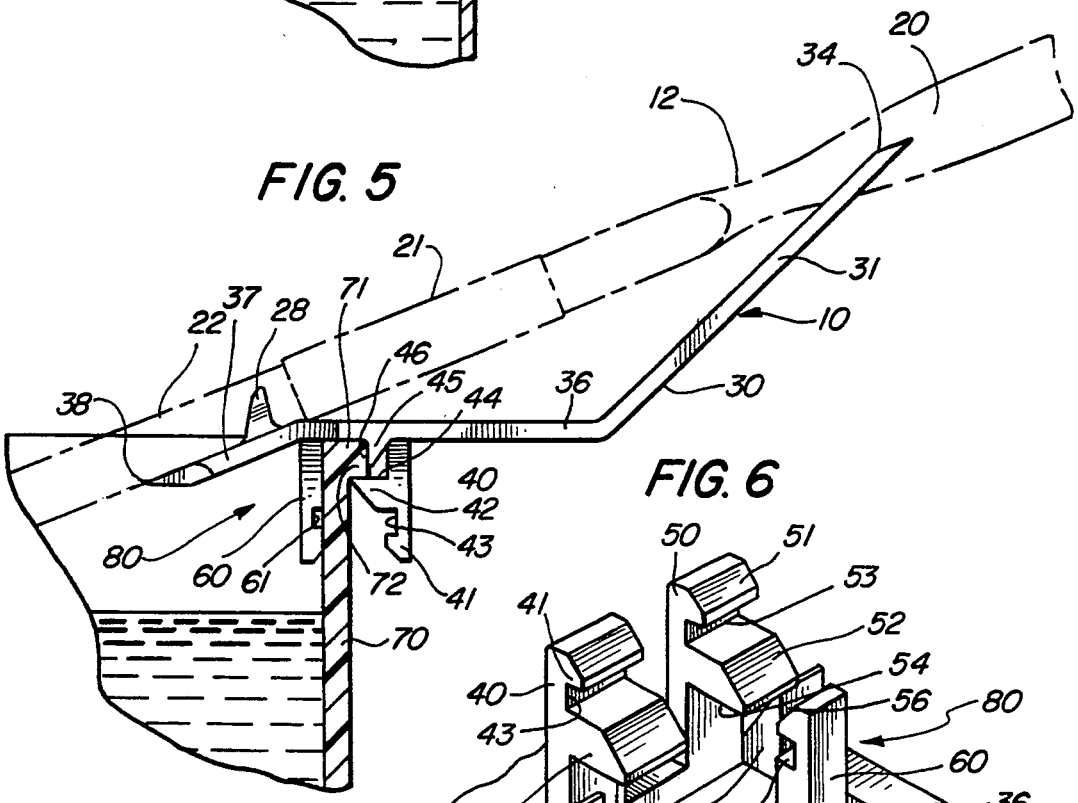
FIG. 5 sets forth a partial section view of the present invention paintbrush holder secured to a typical molded plastic five gallon paint container.

FIG. 5 sets forth a partial section view of the present invention brush holder secured to a conventional five gallon paint container generally referenced by numeral 70. Paint container 70 is fabricated of a molded plastic material and defines an upper edge portion 71 having an outwardly extending lip 72. As described above, brush holder 10 includes a horizontal portion 36 joined to a triangular extended portion 37 defining a straight edge 38 and an upwardly angled portion 31 forming a concave notch 32 together with a pair of prongs 33 and 34 (better seen in FIG. 1). A tab 28 extends upwardly from triangular extended portion 37 and an edge attachment generally referenced by numeral 40 extends downwardly from horizontal portion 36. As is better seen in! FIG. 6, edge attachment 80 includes a post 40 having a pair of inwardly extending tabs 41 and 42 defining a notch 43 therebetween. Tab 42 defines a generally planar surface 44. A triangular shaped tab 45 defines a surface 46. Similarly, a post 50 defines inwardly extending tabs 51 and 52 forming a notch 53 therebetween. Tab 52 further defines a surface 54. A triangularly shaped tab 55 defines a planar surface 56. Edge attachment 80 further includes a post 60 having a notch 61 formed therein. In accordance with an important aspect of the present invention, brush holder 30 is securable to edge 77 and lip 72 of paint container 70 without modification or adjustment of brush holder 10. Thus, brush holder 10 is forced downwardly upon upper edge 71 causing post 60 and posts 40 and 50 to flex outwardly until upper edge 71 and lip 72 are received in the locked position shown in FIG. 5. Thereafter, the resilience of posts 40, 50 and 60 locks upper edge 71 of container 70 in place and secures brush holder 10 to paint container 70 in the manner shown. Thus, tabs 42 and 52 of posts 40 and 50 respectively are received beneath the underside of lip 72 while surfaces 46 and 56 of tabs 45 and 55 contact the outer edge of lip 72 and captivating upper edge 71 between surfaces 46 and 56 and interior surface of post 60. As a result, without modification or adjustment, brush holder 10 is easily secured to paint container 70.

Figure 6:
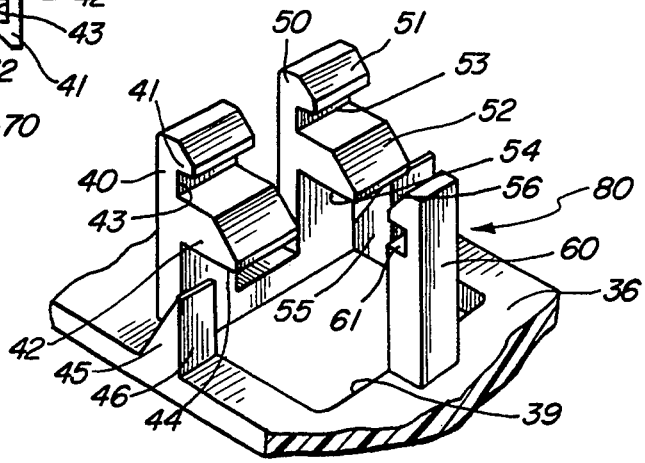
FIG. 6 sets forth a partially sectioned perspective view of the paint container attachment mechanism of the present invention paintbrush holder seen from the underside.

FIG. 6 sets forth a partially sectioned perspective view of edge attachment 80. As described above, brush holder 10 defines a horizontal portion 36 having an aperture 39 formed therein. A pair of triangularly shaped tabs 45 and 55 are positioned on either side of aperture 39 and define planar surfaces 46 and 56 respectively. A post 60 is generally rectangular in cross-sectional shape and is positioned at the approximate center of one edge of aperture 39. Post 60 defines a notch 61. Edge attachment 80 further includes a pair of posts 40 and 50 having a substantially identical construction. More specifically, post 40 defines a pair of inwardly extending tabs 41 and 42 defining a notch 43 therebetween. Tab 42 further defines a planar surface 44. Similarly, post 50 defines inwardly extending tabs 51 and 52 forming a notch 53 therebetween. By further similarity, tab 52 defines a planar surface 54. Thus, posts 40, 50 and 60 together with tabs 45 and 55 are operative in the manner described above to provide a resilient or snap-fit edge attachment mechanism which is utilized in attachment of brush holder 10 to both conventional paint cans of the type shown in FIG. 4 and conventional five gallon commercial paint containers of the type shown in FIG. 5. Aperture 39 is formed in horizontal portion 36 to facilitate the molding fabrication of brush holder 10 and particularly edge attachment 80.

What has been shown is a convenient easy to use brush holder which improves upon the conventional brush holders known in the art by providing a single one-piece structure which conveniently retains a paint laden paint brush and which is attachable to conventional paint containers in a simple snap-fit attachment without the need of threaded fasteners or other mechanical clamps or the like. The brush holder further includes a pair of extending prongs which may be utilized to pry paint can lids open. The present invention brush holder shown further includes a straight edge portion useful as a shield or masking device during the painting operation. The entire structure is fabricated of a molded plastic material as a single molded unit and thus is easily washed or cleaned and is relatively inexpensive to manufacture.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. For use in combination with a paint container defining an upper edge and a paintbrush having an elongated handle and a plurality of bristles, a paintbrush holder comprising:

a frame defining a horizontal portion, a generally triangular extended portion extending downwardly from said horizontal portion, and an upwardly angled portion extending from said horizontal portion generally opposite from said generally triangular extended bristle rest portion and defining a paintbrush handle resting notch therein;

edge attachment means having first and second posts and a third post spaced from said first and second posts, said posts extending downwardly from said horizontal portion to receive a portion of said upper edge between said posts, each post having a notch formed therein for snap-fit attachment of said paintbrush holder to said upper edge of said paint container within said notches to support said paintbrush holder with said triangular extended bristle rest portion angled downwardly into said paint container; and a bristle engaging tab extending upwardly from said generally triangular extended bristle rest portion for engaging the bristles of a paintbrush resting upon said holder and preventing the paintbrush from sliding downwardly.

2. A paint brush holder as set forth in claim 1 wherein said generally triangular extending portion defines a straight edge for paint masking.

3. A paint brush holder as set forth in claim 2 formed of a single integral one-piece molded plastic unit.

4. For use in combination with a standard one-gallon paint container and a standard five-gallon paint container each defining respective upper edges, a paintbrush holder comprising:

a generally planar horizontal portion having downwardly extending first and second resilient posts defining respective first and second lip-receiving notches and first and second respective inwardly extending tabs, and a resilient third post spaced from said first and second posts and defining a third lip-receiving notch, said first, second and third lip receiving notches being coplanar;

an upwardly angled portion extending from said generally horizontal portion and defining a concave notch therein;

a downwardly angled portion extending from said generally horizontal portion oppositely from said upwardly angled portion; and a tab extending upwardly from said downwardly angled portion, said paintbrush holder being securable to the upper edge of either said one-gallon paint container or said five-gallon paint container in a snap-fit attachment of said posts.

5. A paintbrush holder as set forth in claim 4 further including a pair of triangular tabs positioned on the outside of said first and second posts and equally spaced from said third post.

6. A paintbrush holder as set forth in claim 5 wherein said downwardly angled portion defines a straight edge for paint masking.

7. A paintbrush holder as set forth in claim 6 formed of a single integral one-piece molded plastic unit.

* * * * *